United States Patent [19]

Watanabe et al.

[11] 4,231,814

[45] Nov. 4, 1980

[54] METHOD OF PRODUCING A VACUUM CIRCUIT BREAKER

[75] Inventors: Ryuji Watanabe, Tokaimura; Hideo Arakawa; Keiichi Kuniya, both of Hitachi, all of Japan

[73] Assignee: Hitachi, Ltd., Japan

[21] Appl. No.: 13,807

[22] Filed: Feb. 22, 1979

[30] Foreign Application Priority Data

Feb. 22, 1978 [JP] Japan ..... 53/18502
Feb. 24, 1978 [JP] Japan ..... 53/19659

[51] Int. Cl.[2] ..... C21D 1/44

[52] U.S. Cl. ..... 148/11.5 C; 75/153; 75/163; 29/622; 148/13.2; 200/144 B

[58] Field of Search ..... 148/11.5 C, 13.2; 75/153, 163; 29/622; 200/144 B

[56] References Cited

U.S. PATENT DOCUMENTS

| | | | |
|---|---|---|---|
| 3,246,979 | 4/1966 | Lafferty et al. | 75/153 |
| 3,450,573 | 6/1969 | Knapton et al. | 148/11.5 C |
| 3,551,622 | 12/1970 | Takeuchi et al. | 75/153 |
| 3,700,842 | 10/1972 | Attia | 75/153 |
| 3,805,000 | 4/1974 | Roy | 75/153 |
| 4,014,689 | 3/1977 | Horst et al. | 75/153 |

*Primary Examiner*—G. Ozaki
*Attorney, Agent, or Firm*—Craig and Antonelli

[57] ABSTRACT

A method of producing a vacuum circuit breaker, the breaker contacts of which are made of a cast alloy which contains copper or a copper alloy as its main component and, as the sub-component, a metal having a lower melting point and a higher vapor pressure than the main component and having a solubility limit to the main component at room temperature, e.g. lead, bismuth or an alloy of lead and bismuth, the sub-component being contained in excess of said solubility limit. The cast alloy is heated at a temperature not lower than 800° C. but not so high as to cause a melting of the cast alloy, in a vacuum atmosphere which ranges in a pressure between $10^{-4}$ and $10^{-6}$ Torr, before the alloy is mounted as the breaker contacts in the vacuum circuit breaker. A plastic working may be imparted to the cast alloy before the mounting, by, for example, forging. Further, a second heat treatment may be effected on the cast alloy to which the plastic working has been imparted, under the same condition as the first heating. The heating is effective in promoting the spheroidization of the sub-component, and contributes to the prevention of exudation of sub-component to the surface of the breaker contact.

10 Claims, 9 Drawing Figures

F I G. I
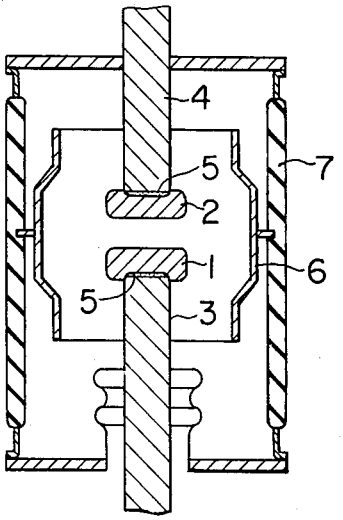

× 100

× 100

× 400

× 400

× 400

× 400

METHOD OF PRODUCING A VACUUM CIRCUIT BREAKER

BACKGROUND OF THE INVENTION

The present invention relates to a method of producing a vacuum circuit breaker and, more particularly, to a method of producing a vacuum circuit breaker having electrodes or contacts made of an alloy containing as the main component copper or copper alloy and a sub-component which is a metal having a lower melting point and a higher vapour pressure than the main component, the sub-component having a solubility limit to the main component at the room temperature and being contained in excess of the solubility limit. Still more particularly, the invention is concerned with a method suitable for the production of a vacuum circuit breaker having contacts made of an alloy in which added to copper is lead, bismuth or an alloy of lead and bismuth, in excessive of its solubility limit to the copper at the room temperature.

In general, the following five characteristics are the essential requisites for the vacuum circuit breaker.

(1) High dielectric strength
(2) Good interrupting ability
(3) Superior non-welding characteristic of contacts
(4) Low chopping current
(5) Small gaseous content in the material of contacts The improvements of these characteristics are generally achieved by improving the properties of the material of contacts. Conventionally, copper has been used as the major material for the contacts of vacuum circuit breakers. However, as a result of the above-mentioned improvement, an alloy containing copper as the main component to which added is iron or cobalt has been developed as a contact material having a superior dielectric strength. Also, as a contact material having superior non-welding property and a low chopping current, an alloy has been developed which contains copper as the main component and a metal having a lower melting point and a higher vapour pressure than the copper, as well as small solid solubility to copper at room temperature, e.g. lead, bismuth or an alloy of lead and bismuth.

The term "chopping" as appearing in the foregoing description of the properties is used to mean such a phenomenon that the current after the breaking is suddenly reduced to zero, before it naturally falls to zero. Thus, the current as observed just before the sudden reduction is referred to as the "chopping current". It is preferred to make the level of the chopping current as low as possible, for otherwise the insulation of the load may be broken. The chopping phenomenon is liable to occur when the arc generated at the time of breaking has a small stability. Therefore, in order to diminish the chopping current, it is suggested to add to the contact material a metal which is easily evaporated by the heat generated by the arc, so as to enhance the stability of the arc. The aforementioned alloy for copper containing lead, bismuth or an alloy of lead and bismuth can maintain a low chopping current, because lead, bismuth or an alloy of lead or bismuth is easily evaporated by the heat of arc, contributing to the stabilization of the arc. At the same time, the presence of lead, bismuth or their alloy in the surface of the contacts facilitate the separation of the contacts, even when they are happened to be welded to each other. Thus, this alloy has also a superior non-welding characteristics.

To explain in more detail about the function of the sub-component such as lead, bismuth or an alloy of lead and bismuth, the copper alloy having such a sub-component is usually produced by casting. In the course of this casting, since such a sub-component has almost no solubility limit to copper at room temperature, the sub-component is made to exist at the grain boundaries. This sub-component then exudes to the surface of the contact, due to its melting by the heat generated by the arc at the time of breaking. Although the presence of this sub-component contributes to the reduction of the chopping current and the improvement of the non-welding characteristic as stated before, too much exudation causes a contamination of the interior of the breaker, resulting in a reduced dielectric strength. In addition, the exudation is caused not only at the time of the breaking but also during the soldering of the contact to the contact holder, so as to deteriorate the solderability.

Therefore, in the alloy as the material of contacts containing a main component of copper or copper alloy and a sub-component of above explained metal, it is a new problem to be solved to reduce the exudation of the sub-component.

SUMMARY OF THE INVENTION

It is therefore an object of the invention to provide a method of producing a vacuum circuit breaker, which is effective to reduce the exudation of the sub-component to the surface of the contact.

It is another object of the invention to provide a method of producing a vacuum circuit breaker, in which the advantages offered by the use of the aforementioned sub-component, e.g. the reduction of chopping current and the increment of the non-welding characteristic, can be increased in comparison with a case wherein the material of as cast state is used as the contacts of the circuit breaker.

To these ends, according to the invention, there is provided a method of producing a vacuum circuit breaker, in which the contacts of the breaker are made by heating a cast material of an alloy up to a temperature higher than 800° C. but not so high as to cause a melting of the alloy, the alloy containing copper or a copper alloy as the main component and, as a sub-component, a metal having a lower melting point and a higher vapour pressure than the main component, as well as a solubility limit to the main component at room temperature, e.g. lead, bismuth or an alloy of lead and bismuth, the sub-component being contained in excess of said solubility limit to the main component at room temperature.

In the usual cast ingot, the copper dendrites are developed extraordinarily, and the sub-component is interposed between the dendrites. The section of this ingot shows a structure in which the sub-component exists at the grain boundaries of the main component. The sub-component exists in a continuous form in the grain boundaries, if it is contained in excess of 3% by weight. If this alloy is heated up to a temperature higher than the melting point of the sub-component, the gaseous component existing at the grain boundaries is expanded, so as to force the sub-component in the molten state to the surface of the alloy. The alloy has been molten under a vacuum, so as to reduce the gaseous component, before it is cast to have the form of the ingot. However, it is impossible to completely remove the gaseous component, and a small amount of gas inevitably remains in the ingot. This remaining gas is expelled to the grain boundaries, in the course of the solidification. When the amount of the sub-component is not greater than 3% by weight, it is not allowed to exist in the continuous form but, rather, exists discontinuously. Therefore, the sub-component is less likely to be forced to the outside of the alloy by the expanded gas. However, when the amount of the sub-component exceeds 3% by weight, a considerably large amount of sub-component is forced out to the outside of the alloy.

The prevention of the exudation of the sub-component can be attributed to the following reason. Namely, since the copper dendrite in the cast material does not exist in the equibrium condition, it has a high surface energy. As the cast material is heated up to a high temperature, the form of the copper dendrite is collapsed, and the copper grain grows in the form of grain growth, so as to form a stable structure. In the course of the grain growth of the copper, the aforementioned sub-component is molten to facilitate the grain growth of the copper, and to reduce its surface energy, so as to assume a spherical form. At the same time, the distribution of the sub-component is rendered discontinuous. Most of this discontinuous form of sub-component is gradually confined in the copper grains as the latter grows. As a result, the most part of sub-component confined in the copper grains and remainder part of the sub-component at the grain boundaries come to exist in the form of discontinuous spheres.

The circuit breaker contact made of the alloy having above-described structure does not exhibit a large amount of exudation of the sub-component to the surface of the contact, although it is rich in the sub-component. In fact, the amount of exudation of sub-component in this alloy is rather small, even in comparison with the cast material of alloy containing less than 3% of sub-component. This tendency of small rate of exudation is attributable to the facts that most of the sub-component is confined in the grains of copper and that the remainder of the sub-component existing at the grain boundaries assumes the discontinuous form. In order to promote the growth of copper grains to such an extent that most of the sub-component is confined in the copper grains, it is necessary to heat the material to a temperature of 800° C. or higher. A heating to a temperature below 800° C. cannot effect appreciable collapse of the copper dendrite and grain growth of copper. As a natural result, in this case, no clear confinement of the sub-component by the copper grains is observed.

On the other hand, the heating temperature cannot be so high as to cause a melting of alloy, because the molten alloy is useless.

The heating is effected in an atmosphere of vacuum. The level of this vacuum is selected so as not to allow substantial oxidation of constituents, and is typically in the order of $10^{-4}$ to $10^{-5}$ Torr. The heating in the vacuum is effective in removing the sub-component which has exuded to the surface of the alloy and the sub-component existing in the grain boundaries in the vicinity of the surface. As a result, the penetration of the sub-component into the solder during the soldering of the contact to the contact holder is prevented, so that the degradation of solderability is fairly avoided. At the same time, the contamination of the interior of circuit breaker is remarkably diminished.

If the heating is effected in an atmosphere other than vacuum, e.g. an inert gas or hydrogen, the above stated removal of sub-component is not performed, so that the degradation of solderability and contamination of interior of the circuit breaker are not avoided. Particularly, an atmosphere of hydrogen incurs, in addition to the above-stated problem, unfavourable absorption or adsorption of the hydrogen gas by the contact material, resulting in a deterioration of internal pressure of the vacuum circuit breaker. The use of hydrogen atmosphere is therefore strictly prohibited.

It is of course possible to evacuate the heating chamber, after heating the alloy in an atmosphere of inert gas or hydrogen up to a temperature in excess of 800° C. but below a temperature which would cause a melting of the alloy. However, this process involves two steps of operation of heating in atmosphere of inert gas or hydrogen gas and evacuation of the heating chamber. In addition, it is necessary to effect the evacuation at a temperature higher than that of the preceding heating step, for otherwise the effect equivalent to that attained by the heating in the vacuum to a temperature higher than 800° C. but lower than a temperature causing a melting cannot be obtained.

The aforementioned heating in the vacuum will be referred to as spheroidizing, hereinafter.

The material of the contact as used in carrying out the invention should be vacuum-melted, so as to make the gaseous content as low as possible. At the same time, in order that the sub-component may be distributed or diffused uniformly over the entire region of the material, the vacuum-melted material should be subjected to a casting. The cast material is then spheroidized as stated before, and the contacts are cut out from the cast material. The contacts thus formed are then incorporated in a vacuum circuit breaker and soldered to the contact holders.

As to the composition, the material of the circuit breaker contact contains copper or a copper alloy as the main component and, as a sub-component, a metal having a lower melting point and higher vapour pressure than the main component and having a solubility limit to the main component at room temperature, the sub-component being contained in excess of the solubility limit at room temperature. Typical examples of the metal which can be used as the sub-component are lead, bismuth and alloys of bismuth and lead.

The sub-component comes to exist in the continuous form in the grain boundaries, when it is contained in excess of 3% by weight, so as to promote the exudation to the surface of the contact. The application of the invention to an alloy containing more than 3% by weight of the sub-component is therefore highly effective. When the amount of the sub-component such as lead, bismuth or alloy of lead and bismuth exceeds 25% by weight, it becomes hardly soluble. Particularly, when the lead content is large, a liquid phase separation is caused to deteriorate the uniformity of the composition of the alloy. Therefore, when such a sub-component is contained, the amount of the sub-component is materially 25% by weight at the largest. Also, from a view point of prevention of degradation of the dielectric strength, it is preferred to limit the amount of sub-component to a level of 25% by weight or lower.

At the same time, it is quite effective and advantageous to repeatedly effect the spheroidizing by effecting such a treatment as capable of imparting a plastic working, e.g. a forging, drawing or rolling, subsequently to the first spheroidizing, and then heating the material again in a vacuum atmosphere to a temperature in excess of 800° C. but not so high as to cause a melting. By imparting the plastic deformation to the spheroidized material, the sub-component in the copper grains is also stretched in the direction of the working. As the spheroidizing is effected again on this alloy, the sub-component is divided into sections, as a result of recrystallization of the copper, and is then spheroidized. The grains are rendered more minute or fine, in the course of this spheroidizing. As a result, the sub-component is distributed more minutely or finely, as compared with the alloy which has been subjected only one spheroidizing after the casting, which conveniently contributes to the stabilization of the chopping current.

If the rate of cooling in the casting is very low, as in the case of, for example, melting and solidification in a crucible, the grains are inconveniently coarsened. In such case, it is possible to effect a grain refining by imparting a plastic working to the material, after the spheroidizing which is carried out subsequent to the casting. By so doing, it is possible to obtain a fine or minute distribution of the sub-component.

BRIEF DESCRIPTION OF THE DRAWINGS

FIG. 1 is a sectional view of an ordinary vacuum circuit breaker,

FIG. 2 is a microscopic photo showing the structure of a Cu-Pb alloy, in which:

FIG. 3 is a microscopic photo of a Cu-Pb alloy in accordance with another embodiment, in which:

DESCRIPTION OF THE PREFERRED EMBODIMENTS

Figure 2A:
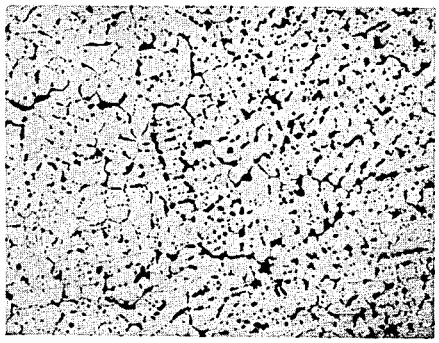
FIG. 2*a* shows the structure after a casting.

FIG. 1 shows an ordinary construction of a vacuum circuit breaker. The circuit breaker has a movable electrode or contact 1 and a stationary electrode or contact 2. These contacts 1, 2 are fixed to respective contact holders 3 and 4, by soldering. When the material of the contacts 1, 2 contains as its sub-component lead, bismuth or an alloy of lead and bismuth, silver solder is suitably used as the soldering material. The interior of the vacuum circuit breaker is evacuated to a vacuum, so as not to materially contain adsorbed gas. This evacuation may be effected before or after the soldering of the contacts to respective contact holders. However, when the contacts 1, 2 are in undesirable condition, gases or other contaminants in the material of the contacts may attach to a shield 6 or an insulating sleeve 7, so that the interior of the vacuum circuit breaker is not evacuated sufficiently. The contacts are produced by spheroidizing a cast material of an alloy which contains as the main component copper or copper alloy and, as a sub-component, lead, bismuth or an alloy of lead and bismuth. In some cases, a plastic working is imparted to the spheroidized material or a second spheroidizing is effected on the material to which the plastic working has been imparted.

Various examples of the material of contact have been tested, the result of which is reported hereinunder.

EXAMPLE 1

A cast alloy containing copper as the main component and 10% by weight of lead as the sub-component was produced by a high frequency melting. An oxygen free copper and a degas-refined lead corresponding to class 1 of JIS H 2105 were used as the materials of the alloy. The high frequency melting was conducted with a crucible of degassed alumina placed inside and a crucible of graphite placed outside, under a pressure of $1\times10^{-5}$ to $5\times10^{-5}$ Torr. At first, only copper was placed in the crucible of alumina and, after confirming the complete melting of the copper, the high frequency heating was stopped and the atmosphere was changed from vacuum to argon gas of about 50 Torr. Then, after the addition of lead, the alloy material was directly cast in a mold and then solidified.

Figure 2B:
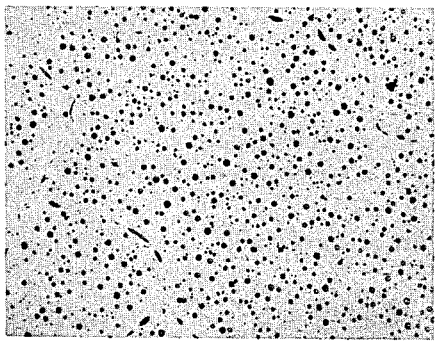
FIG. 2*b* shows the structure as obtained by a spheroidizing effected subsequently to the casting.

The Cu-10 wt% Pb alloy thus obtained was then subjected to a scalping, and was heated for 1 hour under a pressure of $5\times10^{-5}$ Torr, at a temperature of 900° C. As a result of this heating, a structure as shown in FIG. 2*a* (magnification 100) was changed to a structure as shown in FIG. 2*b* (magnification 100). It will be seen that the Pb phase has been spheroidized and most part thereof has been confined in the grains of copper. The Pb content after this heating was analyzed to be about 7% by weight. Breaker contacts were cut out from the Cu-7 wt% Pb alloy as obtained through the above-stated spheroidizing. The cut out contacts were then soldered to a contact holders in an atmosphere of $H_2$ gas, at a temperature of 850° to 900° C., with an eutectic Ag solder. As a result, no exudation of Pb to the surface of the contact was observed. Then, the contacts were mounted in a vacuum circuit breaker, and a degassing was effected for 10 hours at 400° C. No substantial evaporation or deposition of Pb to the breaker wall was observed.

The chopping current of this vacuum circuit breaker was measured with a testing current of 15 A at 6.3 KV. The mean value of chopping current was 5.2 A, which is about a half of that of Cu.

As has been explained, the contact material of Cu-Pb alloy having spheroidized Pb component exhibits substantially no exudation of Pb and a low chopping current.

EXAMPLE 2

Bi of 99.9% purity was prepared, and a Cu-5 wt% Pb-7 wt% Bi was produced in the same manner as the EXAMPLE 1. The ingot was then subjected to a spheroidizing which was effected for 1 hour at 800° C., under a pressure of $5\times10^{-5}$ Torr. As a result of this spheroidizing, the structure was changed to have and alloy phase of Pb and Bi confined in the Cu grains. Breaker contacts were cut out from this material and were soldered to contact holders in the same manner as the EXAMPLE 1. No exudation of Pb or Bi was observed. After mounting these contacts in the vacuum circuit breaker, a degassing was effected in the same manner as EXAMPLE 1, but no contamination of the breaker wall was confirmed. The mean chopping current was measured to be 4.3 A, which is about 1/2.5 of that of Cu. Thus, it was confirmed that the breaker contact made of Cu-Pb-Bi alloy containing spheroidized PbBi alloy phase exhibits no exudation of Pb-Bi and low chopping current.

EXAMPLE 3

Cu-10 wt% Bi alloy, Cu-25 wt% Pb alloy, Cu-5 wt% (Pb-40 wt% Bi) alloy and Cu-25 wt% (Pb-50 wt% Bi) alloy were processed into breaker contacts in the same way as EXAMPLE 1, and were subjected to a spheroidizing which was effected for 1 hour at 900° C. to 950° C., under an atmosphere of vacuum of $5\times10^{-5}$ Torr. In each case, the Pb, Bi or (PbBi) phase was observed to have been changed from a continuous form into spherical discontinuous form, and was confined in Cu grains. These alloys were then subjected to a heating which was effected, so as to simulate the soldering condition, at a temperature of 800° C. for 30 min. in $H_2$ gas. No exudation of sub-component was observed after this heating.

EXAMPLE 4

Figure 3A:
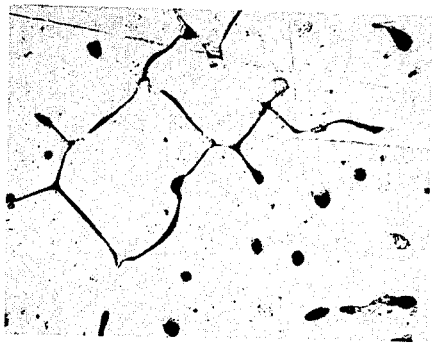
FIG. 3*a* shows the structure after a casting.
Figure 3B:
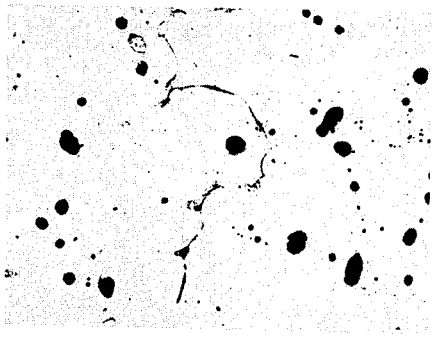
FIG. 3*b* shows the structure as obtained by a spheroidizing effected subsequently to the casting.

Cu-7 wt% Pb alloy was produced by a high frequency melting, from an oxygen free copper and a degas-refined lead. The high frequency melting was effected under a pressure of $1\times10^{-5}$ to $5\times10^{-5}$ Torr, in an alumina crucible of 50 mm diameter placed within a graphite crucible, respectively. The amount of melting of copper and lead as a total was 2.5 Kg. In order to avoid the loss of lead due to evaporation under vacuum and high temperature or the like reason, the vacuum atmosphere was substituted by argon gas of 10 to 50 Torr, after confirming the complete melting of copper, and then the lead was added and the melt was solidified in the crucible. The ingot thus obtained was then subjected to a spheroidizing which consists in heating at 900° C. for 1 hour, under a pressure of $5\times10^{-5}$ Torr. FIG. 3*a* (magnification 400) shows the structure immediately after the solidification, while FIG. 3*b* (magnification 400) shows the structure after the spheroidizing. It will be seen that, while the lead in the structure as shown in FIG. 3*a* assumes a continuous form which extends along the grain boundaries, the lead is substantially spheroidized and most part thereof is confined in the copper grains in the structure shown in FIG. 3*b*.

Figure 3C:
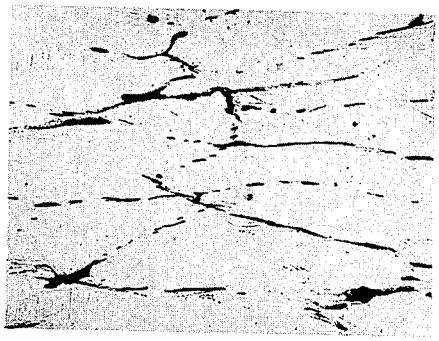
FIG. 3*c* shows the structure as obtained by a forging after the spheroidizing.
Figure 3D:
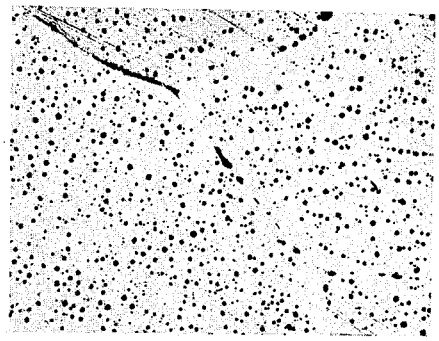
FIG. 3*d* shows the structure as obtained by a second spheroidizing effected subsequently to the forging.

Further, a cold tup forging was effected on the ingot material after the heating. The structure after this forging was as shown in FIG. 3*c* (magnification 400). The working ratio at this stage is 50%. The forged ingot was then subjected to a second spheroidizing which consists also in a heating at 900° C. for 1 hour under a pressure of $5\times10^{-5}$ Torr. The structure after this second spheroidizing is as shown in FIG. 3*d* (magnification 400). It will be seen that copper grains have been grown to larger sizes, and the spheroidized lead has been distributed finely. The lead content after the aforementioned spheroidizing treatment was analyzed to be 5.5% by weight, which does not cause any specific problem.

Breaker contacts were cut out from thus treated ingot, and were placed in an insulation sleeve. Then, a heating was effected to simulate the heating (soldering at 850° to 900° C.) in the process for manufacturing the vacuum circuit breaker, at a temperature of 900° C. for 1 hour, under a pressure of $5\times10^{-5}$ Torr. Then, the surface of the contact was examined for any exudation of lead, but no substantial exudation was observed.

Then, the chopping current was measured for this vacuum circuit breaker, with a test current of 15 A at 6.5 KV. The mean chopping current was as low as 5 A which is about a half of that of copper. The fluctuation of the chopping current in the repeated tests was very small. This means that the vacuum circuit breaker has a stable chopping characteristic.

EXAMPLE 5

Cu-4 wt% Pb-3 wt% Bi alloy was produced by the same ingot-making method as EXAMPLE 4. The purity of the bismuth used was 99.9%. Then, a spheroidizing was effected by heating at 850° C. for 1 hour, under a pressure of $5\times10^{-5}$ Torr. As a result, the Pb-Bi alloy has been divided into sections and spheroidized, and the same change of structure as that observed in EXAMPLE 4 was confirmed also in this case. Then, a cold tup forging was effected on the ingot, to a working ratio of 50%. The forged ingot was then heated at 850° C. for 1 hour, under a pressure of $5\times10^{-5}$ Torr. The lead and bismuth were grain-refined and distributed in the form of spheres.

Subsequently, after cutting out breaker contacts from this ingot, a heating was effected simulating the soldering, at 850° to 900° C. under a pressure of $5\times10^{-5}$ Torr. Then, the exudation of Pb-Bi alloy was examined. As a result, a good condition with extremely small contamination of insulating sleeve wall and contact surface was confirmed. The mean chopping current as measured in the same way as the foregoing examples was as low as 5.0 A.

As has been described, according to the invention, the exudation of sub-component is effectively prevented and, at the same time, the chopping current can be maintained at a low level.

What is claimed is:

1. A method of producing a vacuum circuit breaker having breaker contacts made of a cast alloy, said cast alloy containing copper or a copper alloy as its main component and, as the sub-component, a metal having a lower melting point and a higher vapour pressure than said main component and having a solubility limit to said main component at room temperature, said sub-component being contained in excess of said solubility limit at room temperature, characterized by comprising the steps of heating said cast alloy in a vacuum atmosphere at a temperature of 800° C. or higher but not so high as to cause a melting of said cast alloy to spheroidize said sub-component in said main component and to remove sub-component exuded to the surface of said cast alloy from said surface and then mounting said cast alloy as said breaker contacts into said vacuum circuit breaker.

2. A method of producing a vacuum circuit breaker as claimed in claim 1, wherein said sub-component is selected from a group of lead, bismuth and an alloy of lead and bismuth, and the amount of said sub-component contained is 25% by weight or smaller.

3. A method of producing a vacuum circuit breaker having breaker contacts made of a cast alloy, said cast alloy containing copper or a copper alloy as its main component and, as the sub-component, a metal having a lower melting point and a higher vapour pressure than said main component and having a solubility limit to said main component at room temperature, said sub-component being contained in excess of said solubility limit at room temperature and being selected from the group consisting of lead, bismuth and an alloy of lead and bismuth, and the amount of said sub-component contained being 3% to 25% by weight, characterized in that said cast alloy is heat treated in a vacuum atmosphere at a temperature of 800° C.

or higher but not so high as to cause a melting of said cast alloy, before said alloy is mounted as said breaker contacts.

4. A method of producing a vacuum circuit breaker as claimed in claim 1, wherein said cast alloy is produced by a vacuum casting which is effected after a vacuum melting.

5. A method of producing a vacuum circuit breaker as claimed in claim 1, wherein the heat treatment in a vacuum atmosphere is effected under a pressure of $10^{-4}$ to $10^{-6}$ Torr.

6. A method of producing a vacuum circuit breaker as claimed in claim 1, wherein said cast alloy is initially formed by casting and solidifying an alloy of the main component and the sub-component in a vacuum atmosphere.

7. A method of producing a vacuum circuit breaker having breaker contacts made of a cast alloy, said cast alloy containing copper or a copper alloy as its main component and, as the sub-component, a metal having a lower melting point and a higher vapour pressure than said main component and having a solubility limit to said main component at room temperature, said sub-component being contained in excess of said solubility limit, characterized by comprising the steps of heating said cast alloy in a vacuum atmosphere at a temperature of 800° C. or higher but not so high as to cause a melting of said alloy, imparting a plastic working to said cast alloy, heating again said cast alloy in a vacuum atmosphere at a temperature of 800° C. or higher but not so high as to cause a melting of said cast alloy, and then mounting said cast alloy as said breaker contacts.

8. A method of producing a vacuum circuit breaker as claimed in claim 7, wherein said plastic working is imparted by a forging.

9. A method of producing a vacuum circuit breaker as claimed in claim 7, wherein said heating after the impartment of the plastic working is effected under a pressure of $10^{-4}$ to $10^{-6}$ Torr.

10. A method of producing a vacuum circuit breaker having breaker contacts made of a cast alloy, said cast alloy containing copper or a copper alloy as its main component and, as the sub-component, a metal having a lower melting point and a higher vapour pressure than said main component and having a solubility limit to said main component at room temperature, said sub-component being contained in excess of said solubility limit at room temperature, characterized by comprising the steps of heating said cast alloy in a vacuum atmosphere at a temperature of 800° C. or higher but not so high as to cause a melting of said cast alloy to spheroidize the sub-component in said main component and to remove the sub-component exuded to the surface of said cast alloy from said surface, imparting a plastic working to the heated cast alloy and then mounting said cast alloy as said breaker contacts.

* * * * *